166-303 SR

2/9/88 XR 4,723,604

United States Patent [19]

Emery

[11] Patent Number: 4,723,604

[45] Date of Patent: Feb. 9, 1988

[54] DRAINHOLE DRILLING

[75] Inventor: Leonard W. Emery, Plano, Tex.

[73] Assignee: Atlantic Richfield Company, Los Angeles, Calif.

[21] Appl. No.: 568,155

[22] Filed: Jan. 4, 1984

[51] Int. Cl.[4] ..... E21B 43/26

[52] U.S. Cl. ..... 166/280; 166/308

[58] Field of Search ..... 166/280, 281, 308, 282, 166/283, 369

[56] References Cited

U.S. PATENT DOCUMENTS

| | | | |
|---|---|---|---|
| 3,127,937 | 4/1964 | McGuire, Jr. et al. | 166/280 |
| 3,858,658 | 1/1975 | Strubhar et al. | 166/280 X |
| 3,878,884 | 4/1975 | Raleigh | 166/308 X |

OTHER PUBLICATIONS

Babcock et al., "Ditribution of Propping Agents in Vertical Fractures", pp. 11-17, Nov. 1967.

*Primary Examiner*—Stephen J. Novosad
*Assistant Examiner*—Thuy M. Bui
*Attorney, Agent, or Firm*—Roderick W. MacDonald

[57] ABSTRACT

A method for drilling and completing a drainhole wellbore wherein the drainhole is hydraulically fractured using a fracturing liquid which has a viscosity that is not substantially greater than that of diesel oil, said fracturing liquid carrying a solid propping agent to be deposited in the fractures to prevent same from closing, whereby due to the low viscosity of said fracturing liquid, said propping agent preferentially settles into fractures which extend downwardly from said drainhole thereby allowing fractures which extend upwardly from said drainhole to close up and prevent premature flow of gas into said drainhole by way of said upwardly extending fractures while leaving said downwardly extending fractures permanently propped open for enhanced production of liquid into said drainhole.

6 Claims, 6 Drawing Figures

DRAINHOLE DRILLING

BACKGROUND OF THE INVENTION

The technique of drilling outwardly from an essentially vertical primary wellbore at least one essentially horizontal drainhole wellbore out into a subterranean geologic formation to produce therefrom desirable fluids such as natural gas, oil, and the like is known in the art.

This invention relates to the drainhole drilling technique and, more particularly, to the completion of the drainhole after it is drilled using hydraulic fracturing procedures. The fracturing procedures known in the art have been modified in a novel manner in accordance with this invention to take unique advantage of the drainhole wellbore situation.

BRIEF SUMMARY OF THE INVENTION

In accordance with this invention, after one or more drainhole wellbores have been drilled from a primary wellbore, at least one of the drainholes is hydraulically fractured in a conventional manner except that the fracturing liquid, contrary to prior art teachings and practices, is not a high viscosity, high gel strength liquid, but rather is deliberately designed to be quite low in viscosity and low in gel strength. Further, in accordance with this invention, a solid, subdivided propping agent is employed to prevent closing of fractures developed by pressuring up the fracturing liquid in the drainhole wellbore itself.

Conventional prior art teachings in the fracturing art are that a high gel strength, high viscosity liquid be employed so that the liquid's carrying capacity for the solid propping agent is substantial. This way the fracturing liquid carries a maximum amount of solid propping agent uniformly out in all directions into all fractures. This results in uniform propping open of all fractures in all directions.

This invention deliberately goes against the conventional teachings of the prior art so that only preferential propping of certain fractures is obtained. However, as will be shown hereafter, such an unconventional approach achieves substantial advantages in the drainhole context.

Normally, in the production of oil and gas from a primary wellbore, the oil producing part of the formation is overlayed or capped with a gas producing upper formation section. It is important for maximum recovery of oil from the formation as a whole that the gas does not prematurely reach, sometimes referred to as gas coning, the primary wellbore or the drainhole wellbore. If this occurs, the gas or oil ratio of fluids produced from the primary wellbore can increase substantially and the oil productivity can be so severely reduced that the well is sometimes rendered uneconomical.

In accordance with this invention, a fracturing liquid is employed which is deliberately of a low viscosity even though it is carrying solid propping agent. Because of the very low carrying capacity for solids of such a low viscosity liquid, the propping agent will not be carried into upwardly extending fractures to any significant extend and will preferentially settle out into fractures which extend downwardly from the drainhole. By not injecting propping agent into fractures which extend upwardly from the drainhole, a situation is obtained in the area around the drainhole wherein fractures extending downwardly therefrom are permanently propped open with propping agent while fractures extending upwardly therefrom are not propped open and allowed to close up again due to natural forces already existing in the formation itself. By allowing the upwardly extending fractures to close up, premature breakthrough of gas into the drainhole from upper portions of the formation is substantially reduced. At the same time, permanently propping open downwardly extending fractures allows for enhanced production of oil from the formation into the drainhole. The overall results of the novel approach of this invention is enhanced oil recovery from a drainhole wellbore without substantially increased gas coning into the same drainhole wellbore.

Accordingly, it is an object of this invention to provide a new and improved method for drilling and completing drainhole wellbores.

It is another object of this invention to provide a new and improved method for fracturing drainhole wellbores.

Other aspects, objects and advantages of this invention will be apparent to those skilled in the art from this disclosure and the appended claims.

DETAILED DESCRIPTION OF THE INVENTION

Figure 1:
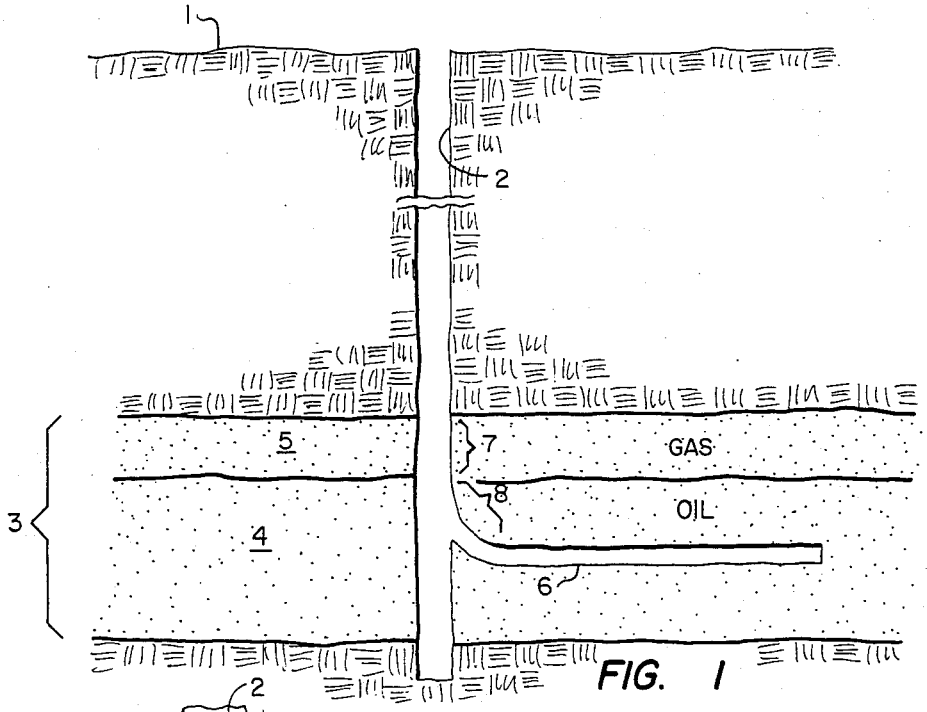
FIG. 1 shows a cross section of a primary wellbore and a laterally extending drainhole wellbore in an oil and gas producing formation.

More specifically, FIG. 1 shows the earth's surface 1 with an essentially vertical primary wellbore 2 drilled downwardly thereinto until it pierces hydrocarbon producing formation 3 which is composed of a lower crude oil producing zone 4 capped with an overlying natural gas producing zone 5. A conventional drainhole wellbore 6 has been drilled laterally from primary wellbore 2 to extend downwardly into formation 3 in about the center of the oil producing zone 4.

It is generally desired to produce the maximum amount of oil through drainhole 6 before any substantial amount of gas from zone 4 reaches that drainhole. If substantial amounts of gas reach drainhole 6 the gas to oil ratio of the fluids produced at earth's surface 1 from primary wellbore 2 can increase to the extent that further production of primary wellbore 2 is rendered uneconomic because so little oil is produced even though a substantial amount of oil is still present in producible form in zone 4. If area 7 of primary wellbore 2 is untreated, gas will be produced directly from zone 5 into wellbore 2, similar reasoning applies to area 8 of the curved portion of drainhole 6 since the distance from the bottom of zone 5 to drainhole 6 is rather short in this area.

Figure 2:
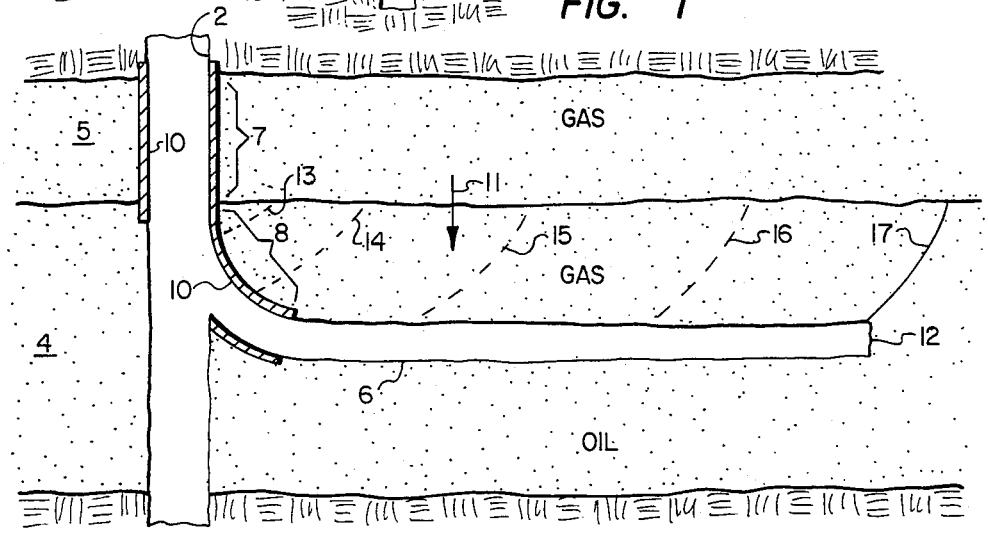
FIG. 2 shows the wellbores of FIG. 1 and shows how gas coning can occur in the drainhole wellbore.

As shown in FIG. 2, areas 7 and 8 of formation zones 4 and 5 can be treated with concrete, water glass, and the like as shown by portion 10 to render the walls of wellbore 2, at least in area 7, and the walls of drainhole 6 in area 8 essentially impervious to gas. This forces the gas to travel downwardly as shown by arrow 11 towards drainhole 6 thereby forcing all oil above drainhole 6 into same before the gas from zone 5. The gas will cone downwardly and progressively from near wellbore 2 out to end 12 of drainhole 6 as shown by dotted lines 13 through 16, respectively. Upon reaching the position shown by line 17 the gas to oil ratio of the fluids produced from drainhole 6 into wellbore 2 can be quite substantial.

Figure 3:
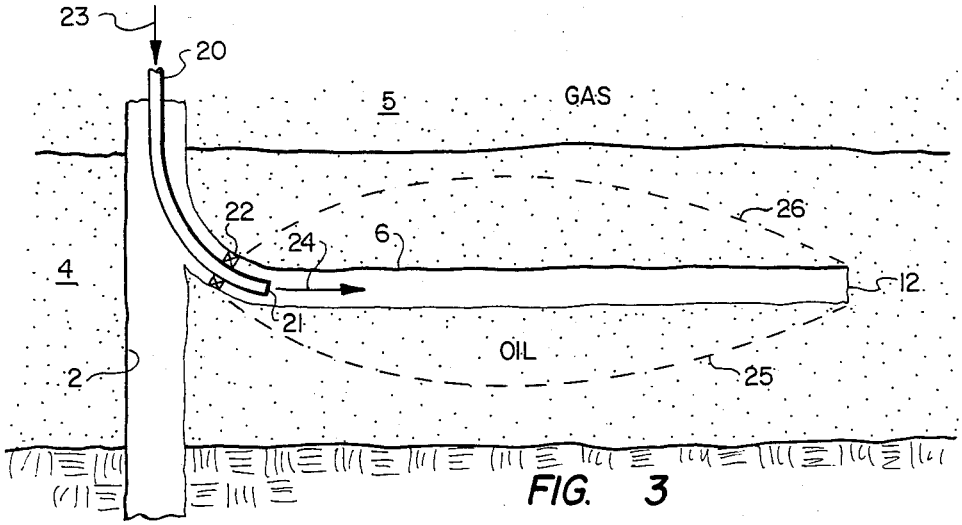
FIG. 3 shows a closeup cross section of the wellbores of FIG. 1 rigged up for fracturing the drainhole.

FIG. 3 shows an enlargement of the cross section of FIG. 2 with the formation portion 10 eliminated only for sake of clarity. In FIG. 3, there is shown a section of tubing 20 which extends from the earth's surface 1 down into drainhole 6. Lower end 21 of tubing 20 is physically separated from communication with wellbore 2 by way of a conventional pack off 22. This way, when fracturing fluid is injected at earth's surface 1 into tubing 20 and passes downwardly therethrough as shown by arrow 23, this fracturing fluid will enter into the interior of wellbore 6 as shown by arrow 24 and be sealed therein by pack off 22. By supplying, in a conventional manner known in the hydraulic fracturing art, enough pressure on the fracturing liquid in tubing 23 after wellbore 6 becomes liquid full, the formation in zone 4 surrounding drainhole 6 can become cracked (fractured) thereby substantially increasing the ability for oil to flow out of zone 4 into drainhole 6 for production to the earth's surface through wellbore 2. The fractures radiating out from drainhole 6 can take the transverse shape shown by dotted lines 25 and 26. It can be seen that the fractures can cover essentially the entire vertical length of the oil producing zone 4 thereby substantially enhancing the ability of oil to flow from remote areas of zone 4 into drainhole 6.

Figure 4:
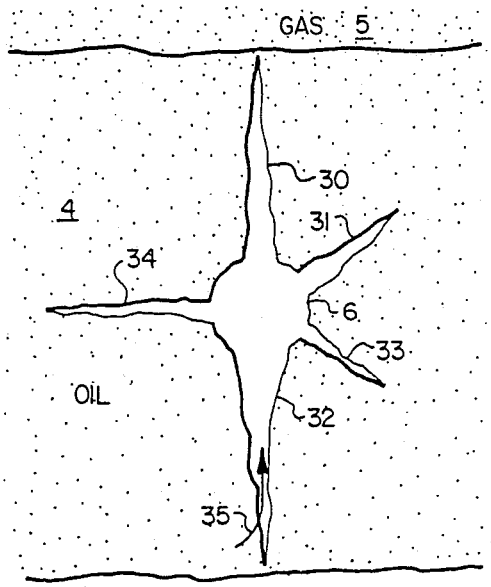
FIG. 4 is a cross section of the drainhole wellbore after fracturing.

The cross section of an end view of the fractured drainhole 6 of FIG. 3 is shown in FIG. 4. In actuality, a very large number of fractures or cracks radiate in all directions out from drainhole 6 but for sake of simplicity only upwardly extending fractures 30 and 31 are shown together with downwardly extending fractures 32 and 33 and essentially horizontally extending fractures 34. Also for sake of simplicity, the description hereinafter will be directed primarily to upward fracture 30 and downward fracture 32.

It can be seen that if the fractures in FIG. 4 can be kept open, a substantial number of conduits are opened up for oil to flow from a remote section of zone 4 into the fractures as shown by arrow 35 and then readily flow through fracture 35 into drainhole 6. Thus, this sort of hydraulic fracturing substantially enhances the amount of oil flowing from formation 4 into drainhole 6. Normally present earth forces within formation 4, which can be many thousands of feet below the surface of the earth, tend to close up fractures 30 through 34 if they are not propped open in some sort of porous manner. In conventional hydraulic fracturing, the fracturing liquid which is introduced into drainhole 6 by way of tubing 20 and thereafter pressured up to form fractures carries with it a subdivided solid material such as sand, aluminum pellets, and many other well known materials. Normally, the materials will be carried out into all of the fractures and deposited therein so that when the normal earth's forces tend to close these fractures, this solid material, normally called propping agent or proppant, keeps the fractures from closing and thereby provides propped open fractures of high porosity so that oil can readily flow therethrough.

In a normal hydraulic fracturing procedure, the fracturing liquid is treated to have a very high gel strength and viscosity so that a very large amount of propping agent can be carried by the fracturing liquid down into drainhole 6 and out into all of fractures 30 through 34 before settling out. Thus, the conventional approach in hydraulic fracturing is to use a high viscosity liquid so that propping agent can be carried out into all of fractures 30 through 34, even upwardly extending fractures 30 and 31, because the goal is to prop open all of the fractures no matter what direction they extend.

Figure 5:
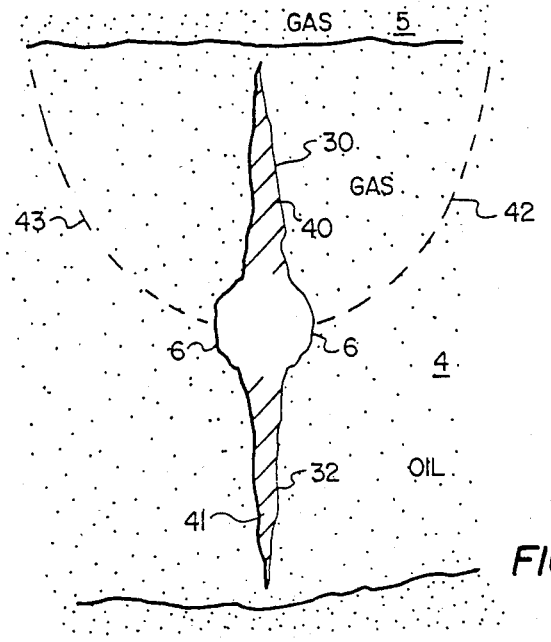
FIG. 5 is a cross section of the same drainhole wellbore after fracturing and showing the effect of gas coning if the upwardly extending fracture remains open.

FIG. 5 shwos a cross section of FIG. 3 with only upwardly and downwardly extending fractures 30 and 32, respectively, in the situation wherein fractures 30 and 32 are propped open with propping agent 40 and 41 as would be accomplished in a conventional hydraulic fracturing process. It can be seen that upwardly extending fracture 30 approaches very close to gas cap 5 and therefore gas can readily cone into fracture 30 to establish gas sweep down to drainhole 6 the extent of which is shown by dotted lines 42 and 43. When the gas sweep reaches the extent shown by 42 and 43 the well has an exceedingly high gas to oil ratio even though a considerably amount of oil is still left to be produced beow lines 42 and 43. Thus, if fracture 30 is propped open a substantial amaount of oil is unproduced by the time the gas to oil ratio becomes excessive.

Figure 6:
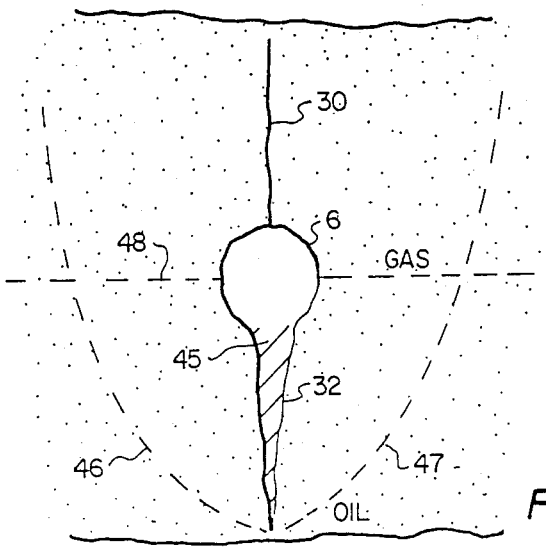
FIG. 6 shows a cross section of the fractured drainhole wellbore in accordance with this invention with the upper fracture closed and the lower fracture propped open.

In accordance with this invention, a fracturing liquid which is deliberately of low viscosity at room temperature and ambinet pressure and of low gel strength is employed so that the propping agent carried therein and to be deposited in the fractures of drainhole 6 readily settles out therefrom. This way, the propping agents will quickly and readily settle into downwardly extending fracture 32, and any similar downwardly extending fracture such as fracture 33 of FIG. 4, because of gravitational forces, and will not be carried to any substantial degree, upwardly into fracture 30 or similar upstanding fractures. By deliberately using a low viscosity fracturing liquid, downwardly extending fractures are preferentially propped open while upwardly extending fractures are not propped to any substantial degree thereby allowing omnipresent forces in zone 4 to close fracture 30 back up as shown in FIG. 6 while leaving fracture 32 full of propping agent 45 and propped open. This way, gas cannot readily reach wellbore 6 by way of fracture 30 because fracture 30 is closed, but oil can still readily reach drainhole 6 by way of propped fracture 32. Thus, the gas cone can reach the bottom of fracture 32 as shown by dotted lines 46 and 47 before an excessively high gas to oil ratio is realized and additional oil recovered below dotted line 48 This was not the case in the situation of FIG. 5 before excessive gas to oil ratios were realized. This demonstrates the enhanced oil recovery possible when practicing this invention in the drainhole context.

The viscosity of the fracturing fluid employed should not be substantially greater than about the viscosity of diesel oil. The fracturing liquid can be water, both sweet and salt, or other aqueous liquid, or a hydrocarbon, preferably kerosene, diesel oil, and similar cuts of crude oil whether along or in mixtures of two or more thereof. Any conventional propping agent can be employed as discussed above.

EXAMPLE

A primary wellbore and drainhole is drilled substantially as disclosed in FIG. 2 wherein drainhole 6 is approximately six thousand feet below earth's surface 1 and is fractured substantially as shown in FIG. 3 using as the fracturing liquid salt water already available in the oil field for waterflooding purposes. The salt water fracturing liquid in an amount of twenty thousand gallons and containing ten thousand pounds of ordinary sand (from about 20 mesh to about 40 mesh) as propping agent is pumped into wellbore 6 and pressured up by way of earth surface fracturing pumps to 4000 pounds per square inch. A fracture pattern such as that shown in FIG. 4 is obtained wherein essentially only the downwardly extending fractures are propped open and the upwardly extending fractures are closed as shown in FIG. 6.

Reasonable variations and modifications are possible within the scope of this disclosure without departing from the spirit and scope of this invention.

What is claimed is:

1. In a method for drilling from a primary wellbore at least one lateral drainhole wellbore, said drainhole extending out into a liquid producing geologic formation which is overlaid with a gas cap, the improvement comprising hydraulically fracturing said formation to form fractures which extend above and below said drainhole, said fracturing being carried out using a fracturing liquid which has a viscosity which is not substantially greater than that of diesel oil, said fracturing liquid carrying a solid subdivided propping agent to be deposited in said fractures to prevent same from closing, whereby due to the low viscosity of said fracturing liquid said propping agent preferentially settles into fractures which extend downwardly from said drainhole thereby allowing fractures which extend upwardly from said drainhole to close up and prevent premature flow of gas into said drainhole by way of said upwardly extending fractures while leaving said downwardly extending fractures permanently propped open for enhanced production of liquid from said formation into said drainhole.

2. The method of claim 1 wherein said fracturing liquid is composed essentially of water.

3. The method of claim 2 wherein said water is salt water.

4. The method of claim 1 wherein said fracturing liquid is composed essentially of at least one hydrocarbon.

5. The method of claim 4 wherein said hydrocarbon is at least one of diesel oil, kerosene, and a mixture thereof.

6. The method of claim 1 wherein said propping agent is sand.

* * * * *